US007469670B2

(12) United States Patent
Rommel et al.

(10) Patent No.: US 7,469,670 B2
(45) Date of Patent: Dec. 30, 2008

(54) ADJUSTABLE CAMSHAFT

(75) Inventors: Jürgen Rommel, Burgstetten (DE); Falk Schneider, Korntal-Münchingen (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 11/807,099

(22) Filed: May 25, 2007

(65) Prior Publication Data

US 2007/0272184 A1 Nov. 29, 2007

(30) Foreign Application Priority Data

May 27, 2006 (DE) ..... 10 2006 024 794

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 5,588,404 A * 12/1996 Lichti et al. ..... 123/90.17
6,386,166 B1 5/2002 Scott et al.

FOREIGN PATENT DOCUMENTS

| | | |
|---|---|---|
| DE | 695 12962 | 5/2000 |
| DE | 10 2004 035 077 A1 | 2/2006 |
| WO | WO 2006/081789 A1 | 8/2006 |

* cited by examiner

*Primary Examiner*—Ching Chang
(74) *Attorney, Agent, or Firm*—Collard & Roe, P.C.

(57) ABSTRACT

The present invention relates to an adjustable camshaft (1) in which an inside shaft (4) is rotatably mounted with respect to an outside shaft (2). To create a relative rotational movement between the two shafts (2, 4), a hydraulic regulating device (3) is provided at one end of the camshaft (1) and a chain/belt wheel (7) that is connected to a drive, in particular to a crankshaft, via a chain or a belt is also provided. It is essential to the invention here that the chain/belt wheel (7) is designed so that it is rotatable in relation to the regulating device (3) for aligning the camshaft (1) with respect to the drive, and after successful alignment, it is connectable in a rotationally fixed manner to either the inside shaft (4) or to the outside shaft (2).

9 Claims, 2 Drawing Sheets

ADJUSTABLE CAMSHAFT

CROSS REFERENCE TO RELATED APPLICATIONS

Figure 1B:
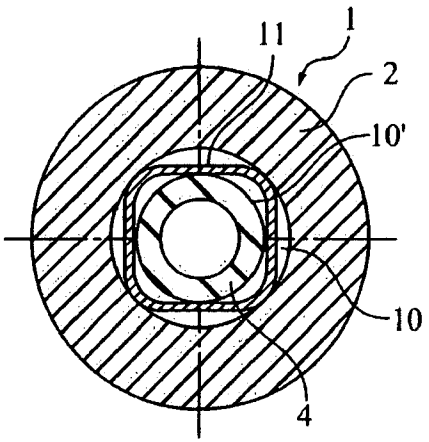

Applicant claims priority under 35 U.S.C. §119 of German Application No. 10 2006 024 794.9 filed May 27, 2006.

The present invention relates to an adjustable camshaft, in particular for internal combustion engines of motor vehicles according to the preamble of Patent Claim 1.

Such a camshaft is known from WO 2006/081789 A1.

The present invention relates to the problem of providing an improved embodiment of a generic camshaft which is characterized in particular by easy assembly.

This problem is solved according to this invention by the subject of the independent Claim 1. Advantageous embodiments are the subject of the dependent claims.

The invention is based on the general idea that when installing the camshaft, a chain/belt wheel that is required for the transfer of force between the camshaft and a drive, e.g., a crankshaft, is rotatably mounted on the camshaft. The inventive camshaft has two shafts, namely an inside shaft and an outside shaft, each fixedly connected to cams and mounted so they can rotate in relation to one another.

The inventive camshaft has two shafts, namely an inside shaft and an outside shaft, each of which is fixedly connected to cams and mounted to rotate in relation to one another. The relative rotation is created by a hydraulic regulating device arranged on one axial end of the camshaft and having a rotor and a stator. In addition, a chain/belt wheel is provided on this axial end of the camshaft, this chain/belt wheel being connected by a chain or a corresponding belt to a drive, e.g., a crankshaft. The chain/belt wheel is designed according to this invention so that during assembly and alignment of the camshaft it can rotate in relation to the regulating device and thus also in relation to the inside shaft and the outside shaft during assembly and alignment of the camshaft with respect to the drive while it can be connected in a rotationally fixed manner to either the inside shaft or the outside shaft after successful alignment of the camshaft with respect to the drive. Due to this fact is it possible to avoid complex alignment and fixation of the two shafts in relation to one another, which thus makes it possible to eliminate manufacturing time and manufacturing cost in particular. In contrast with immediate fixation of the chain/belt wheel on the regulating device and/or on the camshaft, the extremely complex job of alignment in particular is eliminated and the job of fixation of the drive, e.g., the crankshaft and the camshaft in relation to one another in the aligned state can be eliminated, which thus allows a great simplification of assembly.

A fixation device running coaxially with the camshaft and bracing the rotor of the regulating device in a rotationally fixed manner against the camshaft is expedient. As an alternative to this, a fixation device arranged in the same way may also be provided, bracing the chain/belt wheel against the inside shaft via the stator of the regulating device in a rotationally fixed manner. Both embodiments allow a rotatable mounting of the chain/belt wheel with the regulating device mounted on the camshaft, whereby in the first case the chain/belt wheel is secured directly by means of the fixation device on the inside shaft via the rotor of the regulating device, while the fixation in the second case is between the aligned chain/belt wheel and the rotor of the regulating device. These two alternative embodiments illustrate the great design freedom so that the camshaft, which is adjustable according to this invention, and/or the regulating device arranged on it can be used in a variety of ways.

In an advantageous embodiment of the inventive approach, the fixation device which runs coaxially with the camshaft is a screw having an outside thread which can be screwed into an inside thread designed to be complementary to the former and provided on an axial end face of the inside shaft. This embodiment allows fixation of the stator of the regulating device on the inside shaft and/or fixation of the chain/belt wheel via the rotor of the regulating device by simply tightening the fixation device designed as a screw, which can be accomplished with a few operations during the assembly process and therefore is extremely easy to accomplish. At the same time, such a means of fixation offers a high reliability and a high load-bearing capacity.

Advantageous exemplary embodiments are illustrated in the drawings and explained in greater detail below.

The figures show in schematic diagrams

Figure 1A:
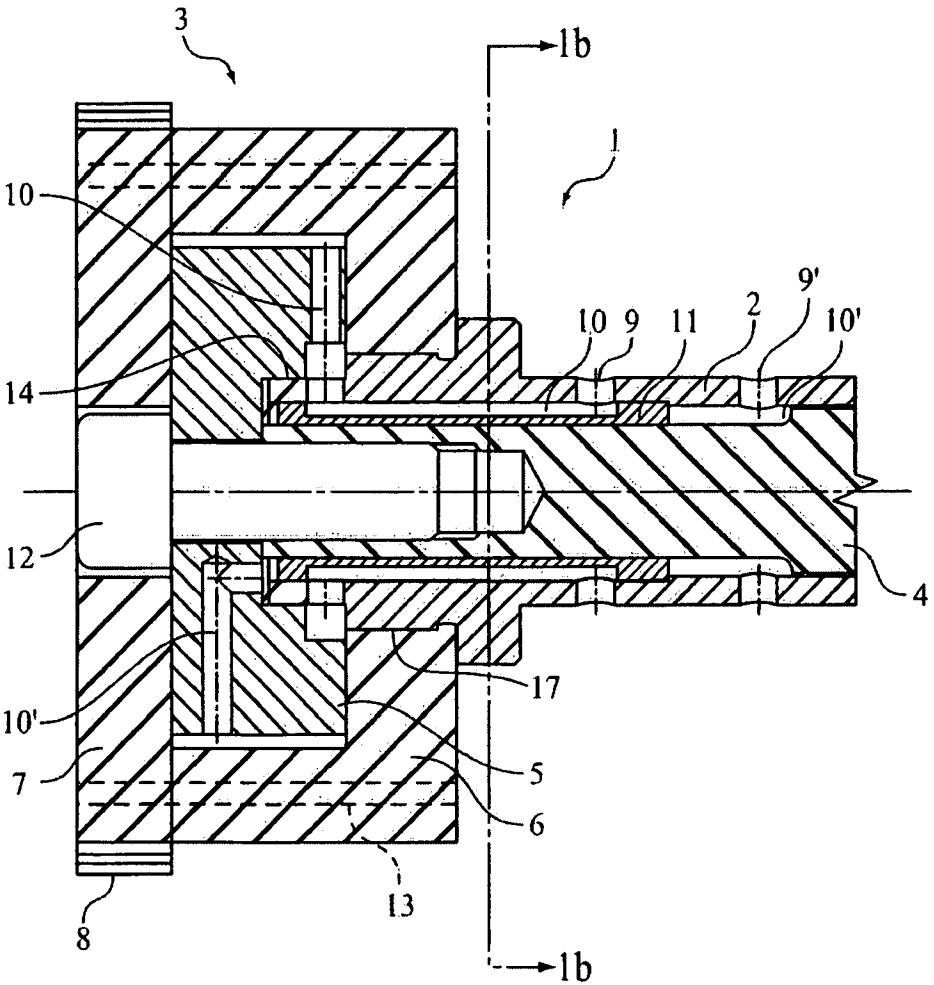
Figure 2B:
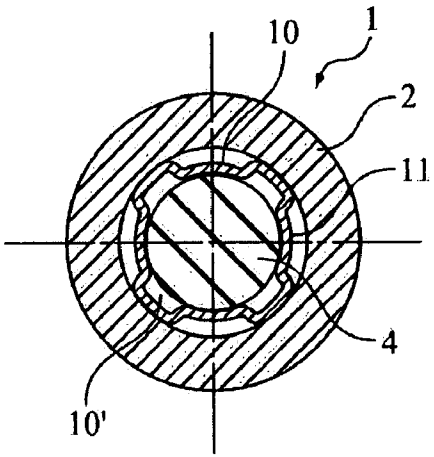
Figure 2A:
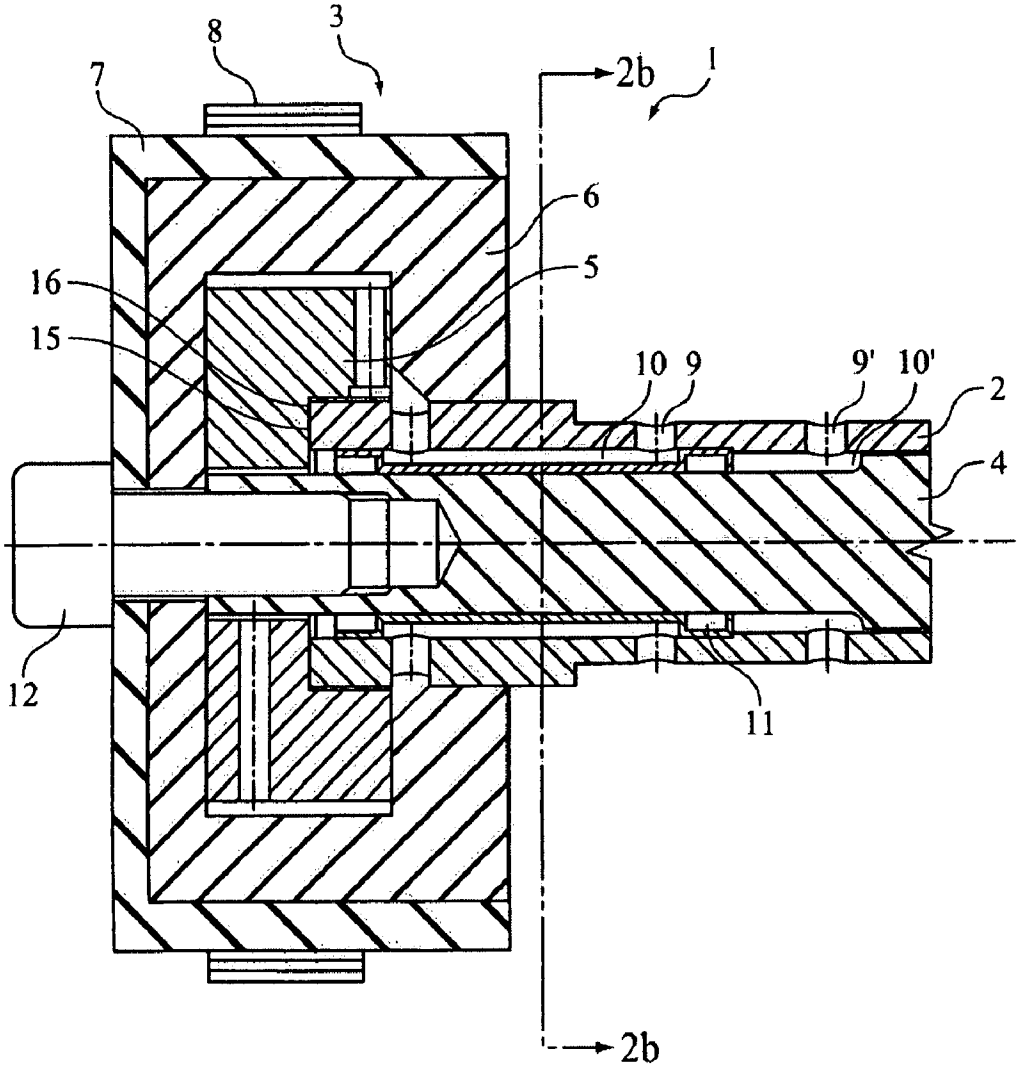

FIG. 1*a* a longitudinal section through an axial end section of an adjustable camshaft having an inventive regulating device, FIG. 1*b* a cross section through the camshaft along the plane 1*b*-1*b*, FIG. 2*a* an alternative embodiment to that according to FIGS. 1*a* and 1*b*, FIG. 2*b* a cross section through the camshaft according to FIG. 2*a* in plane 2*b*-2*b*.

According to FIGS. 1*a* and 1*b*, an axial end area of an adjustable camshaft 1 has an inside shaft 4 mounted rotatably in an outside shaft 2 via a hydraulic regulating device 3 arranged in the front end. The two shafts 2 and 4 each have cams (not shown) fixedly connected to one of the shafts 2, 4 for valve control of an internal combustion engine. The cams fixedly connected to the inside shaft 4 are connected by pins through the outside shaft 2, thus allowing independent rotational movement of the inside shaft with the cams pinned to it with respect to the outside shaft 2. To produce a relative rotation between the inside shaft 4 and the outside shaft 2, a hydraulic regulating device 3 which has a stator 5 and a rotor 6 plus a chain/belt wheel 7 is provided, as mentioned above. The chain/belt wheel 7 preferably has a toothed rim 8 arranged on the circumference and is connected via a chain (not shown) or a belt to a drive (likewise not shown), in particular to a crankshaft.

In general, hydraulic regulating devices 3 are known from the state of the art, which is why they will not be explained in greater detail here. For a better understanding of the present invention, however, it should be mentioned that such a regulating device 3 contains a number of hydraulic chambers that must be acted upon alternately with hydraulic fluid to create the required rotational adjustment of the two shafts 2 and 4. This hydraulic fluid is supplied and removed through the end area of the camshaft 1 comprising the outside shaft 2 and the inside shaft 4. The fluid is supplied and removed through the outside shaft 2 via radial openings 9 and 9' which communicate with the respective channels 10, 10'. These channels run inside the camshaft 1, wherein a sleeve 11, which is arranged between the inside shaft 4 and the outside shaft 2 and has a different cross section than the shafts 4, 2, for example, may serve as the partition between the two channels 10, 10'. The channel 10 is thus situated between the outside shaft 2 and the sleeve 11, while the channel 10' runs between the inside shaft 4 and the sleeve 11. In the area of the regulating device 3, the channels 10 and 10' run radially outward and supply a hydraulic chamber of the regulating device 3 (not shown) with hydraulic fluid.

According to this invention, the chain/belt wheel 7 is designed so that for alignment of the camshaft 1, it can rotate with respect to the drive, i.e., with respect to the crankshaft, in relation to the regulating device 3 and thus in relation to the inside shaft 4 and the outside shaft 2, and after successful alignment, it can be connected in a rotationally fixed manner to either the inside shaft 4 or the outside shaft 2. The camshaft 1 according to FIGS. 1*a* and 1*b* is the embodiment in which the chain/belt wheel 7 is connected to the outside shaft 2 in a rotationally fixed manner after successful alignment, whereas in the embodiment according to FIGS. 2*a* and 2*b*, it is connected to the inside shaft 4 in a rotationally fixed manner. In the axial end area of the camshaft 1 in which the regulating device 3 is arranged, a fixation device 12 which runs coaxially with the camshaft 1 and braces the stator 5 of the regulating device 3 in a rotationally fixed manner against the inside shaft 4 according to FIG. 1*a* is also provided. The fixation device 12 may be, for example, a screw which has an outside thread that can be screwed into an inside thread having a complementary design provided on an axial end face of the inside shaft 4. The stator 5 is thus fixedly connected to the inside shaft 4, while the rotor 6 is fixedly connected to the outside shaft 2. As also shown in FIG. 1*a*, the fixation device 12 passes through the chain/belt wheel 7 without coming in connect with it.

In order to be able to align the chain/belt wheel 7 in relation to the inside shaft 4 and/or in relation to the outside shaft 2, it is provided that the rotor 6 of the regulating device 3 and/or the chain/belt wheel 7 has elongated holes which are curved in the circumferential direction and fixation means 13 connecting the two together pass through these elongated holes. The fixation means 13 are represented by a line shown as interrupted in FIG. 1*a* and may be implemented, for example, by a screw having a counter nut. A rotational movement of the chain/belt wheel 7 with respect to the inside shaft 4 and the outside shaft during the alignment of the camshaft 1 with respect to the drive is allowed through the elongated holes which are curved in the circumferential direction and which receive the fixation means 13.

To be able to separate the hydraulic channels 10 and 10' from one another in the regulating device 3, a moving radial seal 14 is provided between the stator 5 of the regulating device 3 and the outside shaft 2.

In the case of the camshaft 1 shown in FIGS. 2*a* and 2*b*, a fixation device 12 is also provided, running coaxially with the camshaft 1, but unlike the embodiment according to FIGS. 1*a* and 1*b*, the chain/belt wheel 7 here is taut against the inside shaft 4 via the rotor 6 of the regulating device 3 in a rotationally fixed manner. The chain/belt wheel 7 shown in FIG. 2*a* also has a different longitudinal sectional shape than the chain/belt wheel 7 according to FIG. 1*a*. The chain/belt wheel 7 according to FIG. 2*a* is essentially designed in the form of a pot and extends around the regulating device 3 and/or the rotor 6 of the regulating device 3 on three sides. In the embodiment according to FIGS. 2*a* and 2*b*, the rotor 6 is also screwed tightly to the outside shaft 2, whereby the chain/belt wheel 7 can be aligned and/or rotated in relation to the rotor 6 and in relation to the stator 5 of the regulating device 3 when the fixation device 12 is released.

In contrast with the embodiment in FIGS. 1*a* and 1*b*, with the embodiment according to FIGS. 2*a* and 2*b* a stationary axial seal 16 is provided between the stator 5 of the regulating device 3 and an end face 15 of the outside shaft 2, separating the two hydraulic channels 10 and 10' from one another. According to FIGS. 2*a* and 2*b*, the chain/belt wheel 7 is designed to can rotate in relation to the regulating device 3 and thus in relation to the inside shaft 4 and the outside shaft 2 to align the camshaft 1 with respect to the drive. In contrast with FIGS. 1*a* and 1*b*, however, after successful alignment the chain/belt wheel 7 is connected to the inside shaft 4 in a rotationally fixed manner via the fixation device 12.

Due to the inventive adjustable camshaft 1, greatly simplified assembly of same can be achieved. According to FIGS. 1*a* and 1*b*, first the rotor 6 of the regulating device 3 is mounted on the camshaft 1 in a rotationally fixed manner, e.g., via a thread 17 on the outside shaft 2, whereby the regulating device 3 has a stator 5 secured on the rotor 6. After meeting the regulating device 3 on the camshaft 1, the camshaft 1 is aligned with respect to the drive in a predetermined angular position and this position is subsequently secured provisionally and a chain (not shown) or a belt (also not shown) is placed around the chain/belt wheel 7 which until this point in time is still rotatable. Of course the chain and/or the belt may also be wrapped around the chain/belt wheel 7 first and the camshaft 1 is only then aligned with respect to the drive. The fact that the last two operating steps can be performed as options is made possible by the fact that the chain/belt wheel 7 is rotatably mounted with respect to the inside shaft 4 as well as with respect to the outside shaft 2 after being mounted.

In another operating step, the chain/belt wheel 7 is connected to the outside shaft 2 in a rotationally fixed manner (see FIGS. 1*a* and 1*b*) or is connected to the inside shaft 4 in a rotationally fixed manner (see FIGS. 2*a* and 2*b*). In this way the provisional fixation can be released and/or eliminated. Due to the rotatable mounting of the chain/belt wheel 7 with respect to the inside shaft 4 and/or the outside shaft 2 during the assembly procedure, it is possible to eliminate a complex and time-consuming alignment and fixation of the two shafts 2, 4 with respect to the drive, so that the mounting of the camshaft 1 is greatly simplified and this makes it possible to save on manufacturing time and reduce costs.

All the features depicted in the description and in the following claims may be essential to the invention either individually or combined in any form.

The invention claimed is:

1. An adjustable camshaft (1), for internal combustion engines in motor vehicles, in which two shafts (2, 4), namely one inside shaft (4) and one outside shaft (2), each fixedly connected to cams, are rotatable in relation to one another, to create a relative movement a hydraulic regulating device (3) having a rotor (6) and a stator (5) is provided on one of the ends thereof and a chain/belt wheel (7) that is connected to a drive, in particular to a crankshaft, via a chain or a belt is also provided, the stator (5) is lockable with respect to the rotor (6) and in the mounted state of the camshaft (1) there is a connection of the stator (5) and of the rotor (6) each to the inside shaft (4) or the outside shaft (2), wherein the chain/belt wheel (7) is designed so that it is rotatable in relation to the regulating device (3) and thus in relation to the inside shaft (4) and the outside shaft (2) for aligning the camshaft (1) with respect to the drive, and after successful alignment it can be connected either to the inside shaft (4) or to the outside shaft (2) in a rotationally fixed manner.

2. The camshaft according to claim 1, wherein a fixation device (12) that runs coaxially with the camshaft (1) is provided, bracing the stator (5) of the regulating device (3) against the inside shaft (4) in a rotationally fixed manner.

3. The camshaft according to claim 2, wherein the fixation device (12) running coaxially with the camshaft (1) is a screw having an outside thread which can be screwed into an inside thread that is designed to be complementary to the former and is provided on an axial end of the inside shaft (4).

4. The camshaft according to claim 1, wherein a fixation device (12) that runs coaxially with the camshaft (1) is provided, bracing the chain/belt wheel (7) against the inside shaft (4) in a rotationally fixed manner via the rotor (6) of the regulating device (3).

5. The camshaft according to claim 1, wherein the rotor (6) of the regulating device (3) and/or the chain/belt wheel (7) has/have elongated holes which are curved in the circumferential direction, with fixation means (13) that connect the rotor (6) and the chain/belt wheel (7) together passing through said elongated holes, and which allow a rotational movement of the chain/belt wheel (7) with respect to the inside shaft (4) and the outside shaft (2) during the alignment of the camshaft (1) with respect to the drive.

6. The camshaft according to claim 1, wherein the fixation device (12) passes through the chain/belt wheel (7) reaches through without coming in contact with it.

7. The camshaft according to claim 1, wherein a moving radial seal (14) is provided between the stator (5) of the regulating device (3) and the outside shaft (2), separating two hydraulic channels (10, 10') that supply the regulating device (3) from one another.

8. The camshaft according to claim 1, wherein a stationary axial seal (16) is provided between the stator (5) of the regulating device (3) and an end face (15) of the outside shaft (2), said axial seal separating two hydraulic channels (10, 10') that supply the regulating device (3) from one another.

9. The method for assembling a camshaft according to claim 1, comprising at least the following method steps:

(a) rotationally fixed mounting of the regulating device (3) on the camshaft (1) with a rotor (6) and a stator (5) secured on one another, (b) aligning the camshaft (1) with respect to the drive in a predetermined angular position, provisionally fixing this position and applying the chain or the belt to the rotatable chain/belt wheel (7) or vice versa, (c) rotationally fixed attachment of the chain/belt wheel (7) to the inside shaft (4) or to the outside shaft (2), (d) releasing the provision fixation.

* * * * *